US009592956B2

(12) United States Patent
Garland

(10) Patent No.: US 9,592,956 B2
(45) Date of Patent: Mar. 14, 2017

(54) WASTE DEVICE FOR REFUSE, PARTICULARLY FOR DIAPERS

(71) Applicant: CTP INNOVATIONS B.V., Nijmegen (NL)

(72) Inventor: Thomas Alan Garland, Bradenton, FL (US)

(73) Assignee: CTP INNOVATIONS B.V., Nijmegen (NL)

( * ) Notice: Subject to any disclaimer, the term of this patent is extended or adjusted under 35 U.S.C. 154(b) by 0 days.

(21) Appl. No.: 14/425,118

(22) PCT Filed: Sep. 2, 2013

(86) PCT No.: PCT/NL2013/050632

§ 371 (c)(1),
(2) Date: Mar. 2, 2015

(87) PCT Pub. No.: WO2014/035249

PCT Pub. Date: Mar. 6, 2014

(65) Prior Publication Data

US 2015/0232268 A1 Aug. 20, 2015

(30) Foreign Application Priority Data

Sep. 3, 2012 (NL) ..... 2009408

(51) Int. Cl.
*B65F 1/10* (2006.01)
*B65F 1/14* (2006.01)
(Continued)

(52) U.S. Cl.
CPC ..... *B65F 1/1607* (2013.01); *B65F 1/0013* (2013.01); *B65F 1/06* (2013.01);
(Continued)

(58) Field of Classification Search
CPC ..... B65F 1/0013; B65F 1/1607; B65F 2001/1676; B65F 2240/132; B65F 1/20; B65F 1/06; B65F 1/10; B65F 1/1676
(Continued)

(56) References Cited

U.S. PATENT DOCUMENTS

2010/0133271 A1* 6/2010 Garland ..... B65F 1/10 220/254.1
2010/0187235 A1* 7/2010 Chen ..... B65F 1/10 220/495.06
2010/0301050 A1* 12/2010 Garland ..... B65F 1/10 220/495.08

OTHER PUBLICATIONS

EPO International Search Report for PCT/NL2013/050632 dated Nov. 22, 2013.

* cited by examiner

*Primary Examiner* — J. Gregory Pickett
*Assistant Examiner* — Elizabeth Volz
(74) *Attorney, Agent, or Firm* — Shumaker, Loop & Kendrick, LLP

(57) ABSTRACT

A waste device including a container having a bottom and a circumferential wall, wherein the container has a container-opening on the end remote from the bottom and closing means positioned near the container opening for substantially closing the container opening in such a way that odor release is prevented. The closing means includes a drum housing and a drum body being pivotable between an insertion position wherein refuse is placeable in a transport container, and a transit position wherein the transport container is aligned with the drum opening. The waste device further including a flexible sealing member having a connection part that is located radially outwards, and that is connected to the drum housing, and having a sealing part that extends radially inward from the connection part and which may be brought into sealingly contact with the
(Continued)

external surface of the drum body for sealing the container opening in a substantially odor-free manner.

11 Claims, 9 Drawing Sheets

(51) Int. Cl.
*B65F 1/00* (2006.01)
*B65F 1/16* (2006.01)
*B65F 1/06* (2006.01)

(52) U.S. Cl.
CPC ..... *B65F 1/10* (2013.01); *B65F 2001/1676* (2013.01); *B65F 2240/132* (2013.01)

(58) Field of Classification Search
USPC .. 220/212, 212.5, 262, 495.05, 495.08, 253, 220/254.8, 318, 495.06
See application file for complete search history.

WASTE DEVICE FOR REFUSE, PARTICULARLY FOR DIAPERS

TECHNICAL FIELD AND BACKGROUND OF THE INVENTION

The present invention relates to waste devices for refuse, in particular for diapers, according to the pre-amble of claim 1, where the waste container is arranged for minimizing odor release associated with the refuse to the surroundings.

Such a waste container is generally known. In a specific embodiment, the waste container is a diaper pail. A conventional diaper pail typically includes a pail portion which holds a disposal bag, and a receptacle assembly mounted on top of the pail configured to receive the soiled diaper and to transfer the soiled diaper into the disposal bag while minimizing the release of odor from previously disposed diapers already within the disposal bag.

Various receptacle assemblies within the prior art have included rotating drums contained within a housing having an opening communicating with the internal disposal bag. The drum has an opening to receive the soiled diaper. To dispose of the diaper, the drum is rotated to align the drum opening with the top opening in the housing. Once the diaper is received into the opening in the drum, the drum is rotated to align the drum opening with the lower opening and allow the diaper to drop into the disposal bag. While these types of diaper pails have had relatively good commercial success, it has been found that the existing designs still do not effectively prevent the escape of odors. Providing a seal around the housing and between the upper receptacle assembly and the lower pail is not a difficult task, as these components do not move relative to each other during normal use and the seals are loaded only in compression, but, this arrangement does require multiple seals and additional related parts as well as additional cost and complexity. On the other hand, the provision of a substantially airtight seal between moving components is not as simple, and the most difficult place to provide a seal is between the moving surfaces of the drum and the lower half of the drum housing.

The inventor's US 2010301050 A1 attempted to provide a diaper pail having an improved plastic annular seal, comprising an outer radial part and an inner radial part that are connected to the drum housing, and having a movable part extending between the outer and inner radial part.

Although the diaper pail disclosed in US 2010301050 A1 provided improved results, it is believed that the odor control can still be improved.

BRIEF SUMMARY OF THE INVENTION

It is thus an object of the invention to provide an improved waste container, particularly suitable for diapers, that overcomes at least one of the aforementioned drawbacks of the prior art. In particularly, it is an object of the invention to provide an improved waste container that provides an improved odor control, and/or is easy cleanable.

It should be noted that the waste container below will be mainly described as being suitable for diapers, but it is to be understood that the waste container can be used for all sorts of goods, or wastes or the like, for which (temporary) storage, having odor control at the same time, is important.

To this end, the invention provides a waste device for refuse, particularly for diapers and the like, of the aforementioned kind, in which the waste device is characterized according to the characterizing part of claim 1.

The waste device according to the invention comprises a container having a bottom and a circumferential wall, wherein the container has a container opening on the end remote from the bottom, wherein the waste device is provided with closing means that are positioned near to the container opening for substantially closing the container opening in such a way that odor release is prevented. The closing means comprise:

- A drum housing provided in the internal part of the waste device, said drum housing having a drum opening facing the interior of the container;
- A drum body having an external surface that is at least partially closely connected to an inner surface of the drum housing, wherein the drum body has a transport container for the refuse, said transport container extending inwardly from the external surface thereof, wherein the drum body is pivotable between an insertion position wherein refuse is placeable in the transport container, and a transit position wherein the transport container is aligned with the drum opening;
- A flexible sealing member extending about the circumferential edge of the drum opening of the drum housing, wherein the sealing member, as seen in an axial cross-section, comprises a connection part that is located radially outwards, and that is connected to the drum housing, and wherein the sealing member comprises a sealing part that is connected to the connection part and that extends radially inward from the connection part and which may be brought into sealingly contact with the external surface of the drum body for sealing the container opening in a substantially odor-free manner.

According to the invention, the end of the sealing part that is remote from the connection part is free from any connection to the drum housing such that a freely movable outer end of the sealing member is formed. Due to the fact that the sealing part is a flexible part that is connected to the connection part, the part that is remote from the connection part is to some extent freely movable in the axial direction (meaning up and down), and independently thereof, movable in the radial direction (meaning sideways). The use of a flexible sealing member, having one freely movable end part, and having the other end part connected to the drum housing, ensures that a good seal is obtained. The sealing member will substantially always be in good contact with the external surface of the drum body, ensuring that a seal is obtained that prevents odor from escaping the internal of the container.

It should be noted that the aforementioned prior art document, US 2010301050 A1, discloses the use of an annular seal, which has two outer ends, both of which are connected to the drum housing. This document describes that in this way, a freely movable edge is formed, which ensures a tighter seal. The seal has contact with the drum at about midway along the seal but the seal also has material below that contact point thereby making the contact edge or point less flexible due to the material below that point. According to the invention, it is preferred that all seal material below the sealing edge is removed, such that a freely movable outer end of the annular seal is obtained, which is not disclosed in US 2010301050 A1.

Thus according to the invention, the sealing member has two outer ends, one of which is connected to the drum housing, and one of which is positioned at a distance of the drum housing, i.e. is free from any connection to the drum housing. The connection part is connected to the drum housing, and the sealing part is substantially free from any connection to the drum housing. i.e. the end of the sealing part that is remote from the connection part is not connected to the drum housing.

It was surprisingly found that the freedom of movement of the annular seal according to the invention was highly improved, by ensuring that the outer end is freely movable. The sealing part according to the invention has a higher degree of freedom, compared to the prior art document 2010301050 A1, which ensures an improved sealing contact between the sealing part and the drum body. In this regard, it should be noted that the connection between the annular seal and the drum housing was not affected, and a tight seal may be obtained.

Further embodiments of the invention are subject of the dependent claims. Some of these, and their advantages, will be explained below.

In an embodiment which has excellent sealing characteristics, the connection part is movably connected to the drum housing. The connection part is preferably movable in an axial direction. In one embodiment the connection part is movable in substantially the axial direction only. Due to the fact that the connection part is movably connected to the drum housing, preferably in the axial direction, the sealing member as a whole is also movable relative to the drum housing, preferably in the axial direction. This highly improves the sealing characteristics of the sealing member, especially when rotating the drum body, since the sealing member may adjust its position.

In a specific embodiment, the connection part is slidably received in a groove of the drum housing, thus enabling movement of the connection part, and the sealing member as a whole. An additional advantage of this embodiment is that there is no need for holes in the drum housing for attaching the connection part. Thus, the drum housing may be manufactured as a continuous surface without holes, yielding an additional barrier for odour release.

In an embodiment, the sealing part extends radially inward from the connection part, towards the bottom of the container. Preferably, the sealing part extends at an angle of approximately 30-60 degrees with respect to the connection part. The angle is preferably adapted to the dimensions of the drum body. In particular, the sealing part may extend at an angle that substantially forms a tangent line of the drum body.

In an embodiment, the sealing part then continues to extend further radially inward, in a direction away (i.e. up) from the bottom of the container. In that sense, the sealing part comprises an outer part that is connected to the connection part and that extends radially inward from the connection part, towards the bottom of the container, as well as an inner part connected to the outer part, which inner part extends further radially inward, in a direction away from the bottom of the container. The outer part and the inner part define a substantially V-shaped axial cross-section of the annular seal. The outer part is substantially transversely directed to the external surface of the drum body. Due to the fact that this part is flexible, it is able to deform in such a way that it closely follows the contour of the external surface of the drum body, such that any irregularities that occur in the external surface, are also correctly sealed.

In an embodiment, the part of the seal that extends the radially inward, in a direction away from the bottom of the container, forms the freely movable end of the seal.

In an embodiment, the sealing part is connected to the drum housing by means of the connecting part only.

The drum body may be slidably connected to the drum housing. The slidable connection may be in such a way that in the transit position the drum body is pressed, under the influence of gravity, on the sealing member. In combination with the sealing member according to the invention, in particular a sealing member that is movably, in an axial direction, connected to the drum housing, this yields better sealing characteristics. In an embodiment, the drum body is substantially spherical in shape, wherein the inner surface of the drum housing is a substantially complementary shape, wherein the outer edge of the drum opening is substantially circular, and wherein the sealing member is substantially annular having a substantially annular sealing part engaging with the substantially spherical outer surface of said drum body.

The waste device may be shaped in such a manner that in at least the insertion position the drum body is actively pressed on the sealing member. This may be arranged in several ways. In one embodiment the drum body has a shape that is not entirely spherical, so that in the insertion position the drum body may press relatively harder on the sealing member. In another embodiment, or additionaly, the inner surface of the drum housing has a shape that is not entirely complementary to the drum body, such that the combination of drum housing and drum body press the drum body on the sealing member. Another embodiment makes use of a drum body that is connected to the drum housing in an off-centered way, such that a pivoting movement of the drum body results in a harder pressing on the sealing member. In one embodiment, the waste device further comprises a cover configured and arranged to be received on the container, wherein the cover comprises a cover opening for supplying waste to the container, wherein the drum housing, when the cover is placed on the container, at least partially encloses the drum body, and wherein, in the insertion position, the transport container is aligned with the cover opening.

In a further embodiment, the waste device further comprises bag holder means for aligning a bag-like container with the drum opening.

The bag holder means may comprise a holder housing having a holder opening, wherein said holder housing is connected to the container, and wherein said holder opening is aligned with the drum opening.

The drum opening comprises in an embodiment a wall that extends from the drum opening towards the bottom of the container, wherein said wall engages the edge of the holder that is formed by the opening of the holder. The bag-like container is then positioned in between the wall and the edge of the holder.

Further features and advantages of the invention will become apparent as the description thereof proceeds when considered in connection with the accompanying illustrative drawings. In the drawings which illustrate the best mode presently contemplated for carrying out the present invention:

DETAILED DESCRIPTION OF THE INVENTION

Figure 1:
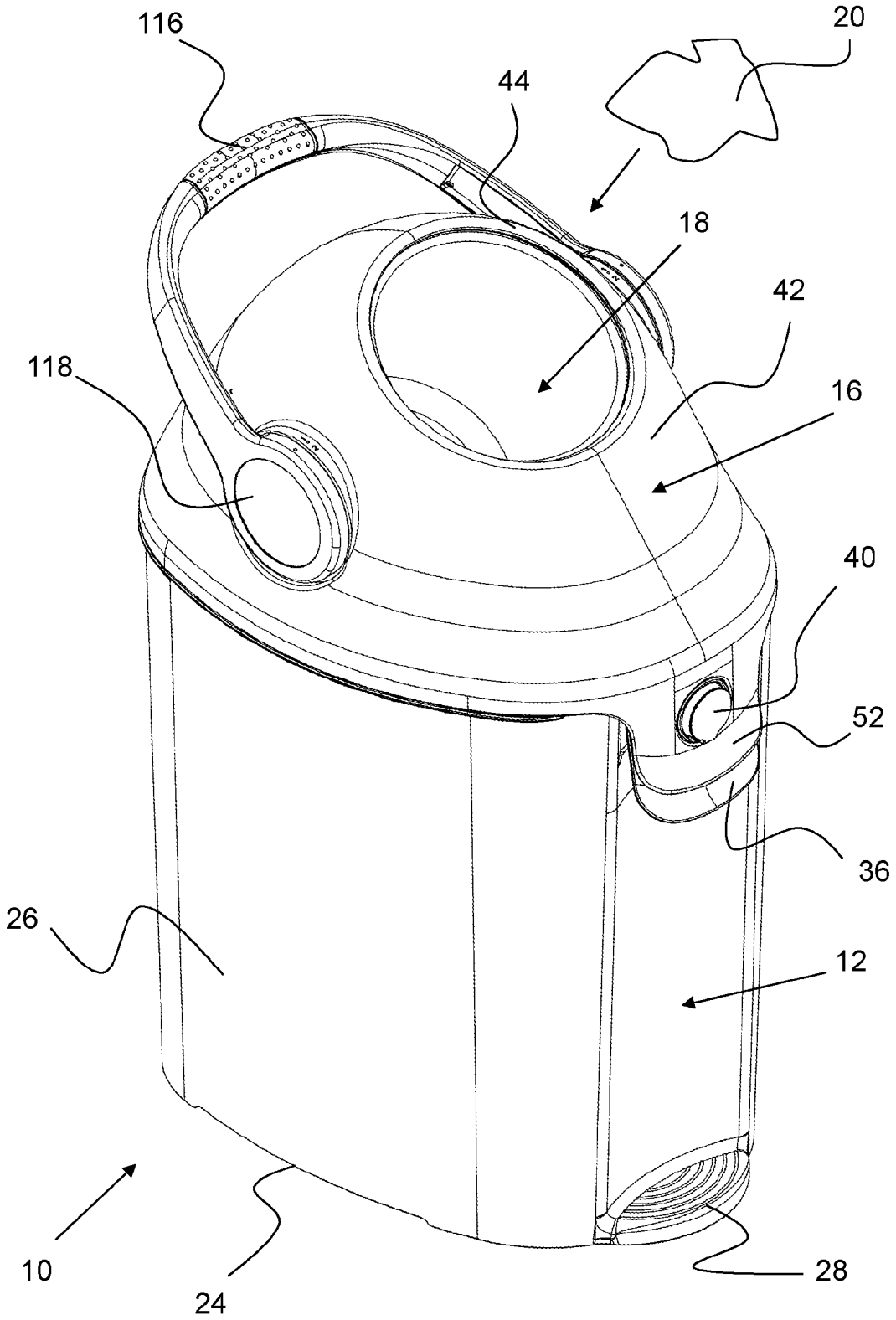
FIG. 1—is a perspective view of the waste disposal device of the present invention, in the embodiment of a diaper pail.

Referring now to the drawings, the diaper pail of the instant invention is illustrated and generally indicated at 10 in FIGS. 1-9. It is noted that the diaper pail is very similar to the one that is described in US 2010 301050, which document is hereby incorporated by reference. For a description of the basic parts of the diaper pail, the reader is referred to said document.

Also, generally, in the following description, reference is made to a diaper pail. It will be clear to those skilled in the art, that the invention is also applicable to other waste disposal devices, irrespective of the type of waste used. In that sense, the waste disposal device is suitable for waste in general.

The waste disposal device 10 as shown in FIG. 1 in the form of a diaper pail 10 comprises a container generally indicated by 12. The container has a bottom 24 and a circumferential wall 26. The pail 12 is generally oval in shape having a closed bottom wall 24, upwardly extending sidewalls 26 and an open top, defining a container opening. A foot 28 is provided at the bottom front of the pail 12 so that the user may step on the foot 28 to stabilize the pail 12 and prevent tipping during use. As can be seen in FIG. 2, the pail 12 is sized to accommodate a conventional kitchen sized disposal bag 22 which is suspended within the pail 12. The end of the circumferential wall 26 that is remote from the bottom 24 of the container 12 defines the container opening, through which waste can be placed in the internal volume of the container 12.

It can be seen in FIG. 1 that the device 10 is provided with a cover member 16 or lid 16. This cover 16 is provided on top of the container opening, and connects to the circumferential sidewall 26 of the container 12. The cover member 16 is releasably connected to the container 12, such that it may be removed from the container. In the embodiment shown, the cover member 16 is pivotably connected to the container 12, such that it may pivot around hinge 34 (see FIG. 5). To this end, several tabs 36, 52, and buttons 40 are provided, which will be described in detail later on.

Referring back to FIG. 1, the cover member 16 comprises an upper wall 42 having a cover opening 44 which is sized to allow a diaper 20, or any waste in general, to pass through. A drum assembly 18 is provided in the internal part of the cover member. This drum assembly 18 forms part of closing means which may be used to substantially close the container opening. The closing means are arranged such that release of odor is prevented. The closing means comprise a drum body, which is pivotably connected to the cover member 16, and which may be pivoted by a user by means of an actuator handle 116, which is connected to the cover member 16 by means of an axle 118.

The functioning of the waste disposal device 10 will be explained by means of FIG. 2*a* and FIG. 2*b*, which show cross sectional views of the diaper pail 10 of FIG. 1. It is noted that the corresponding parts are each provided with their respective reference sign.

Figure 2A:
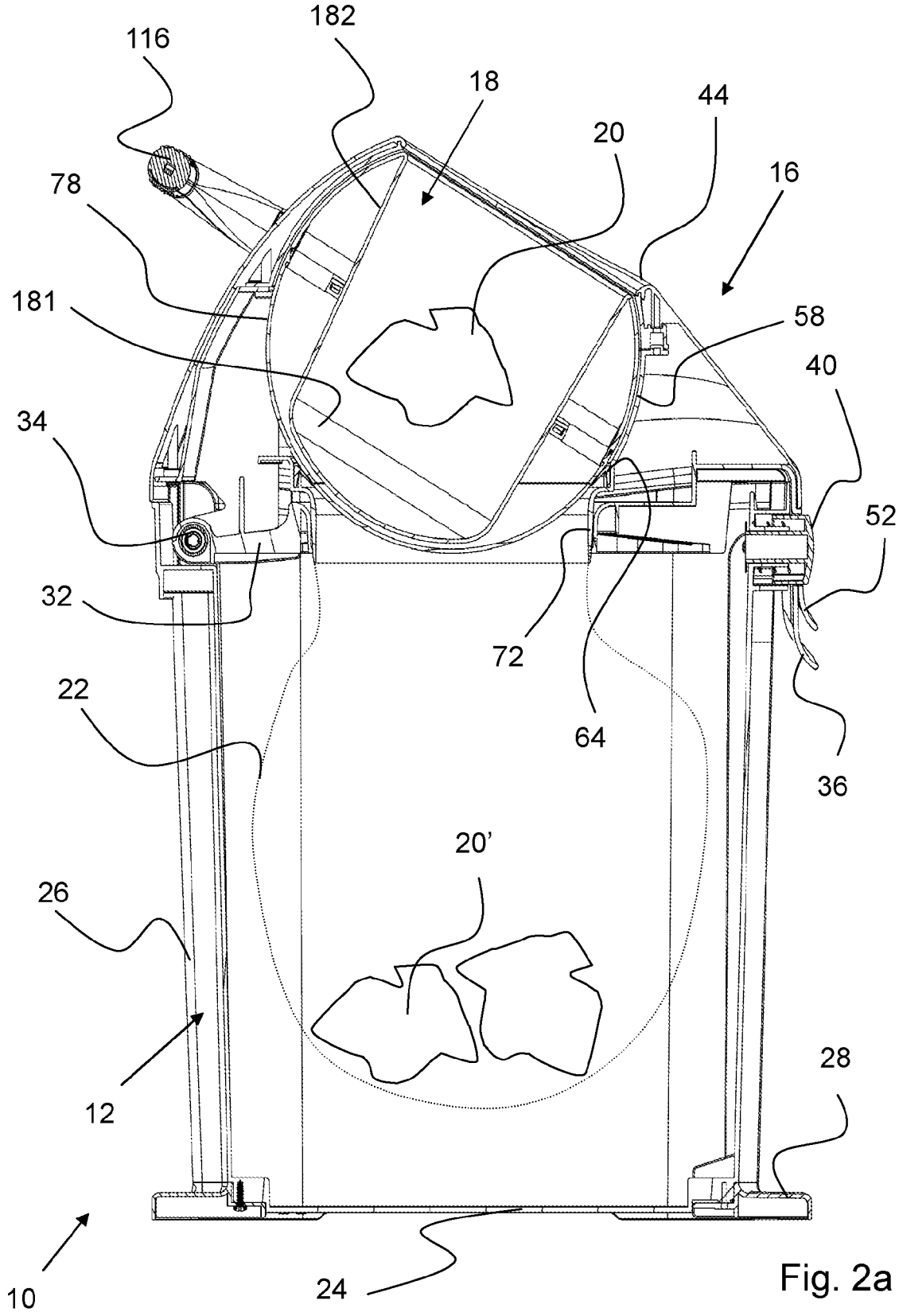
FIG. 2A—is a side view in cross section of the diaper pail of FIG. 1, in the insertion position.
Figure 2B:
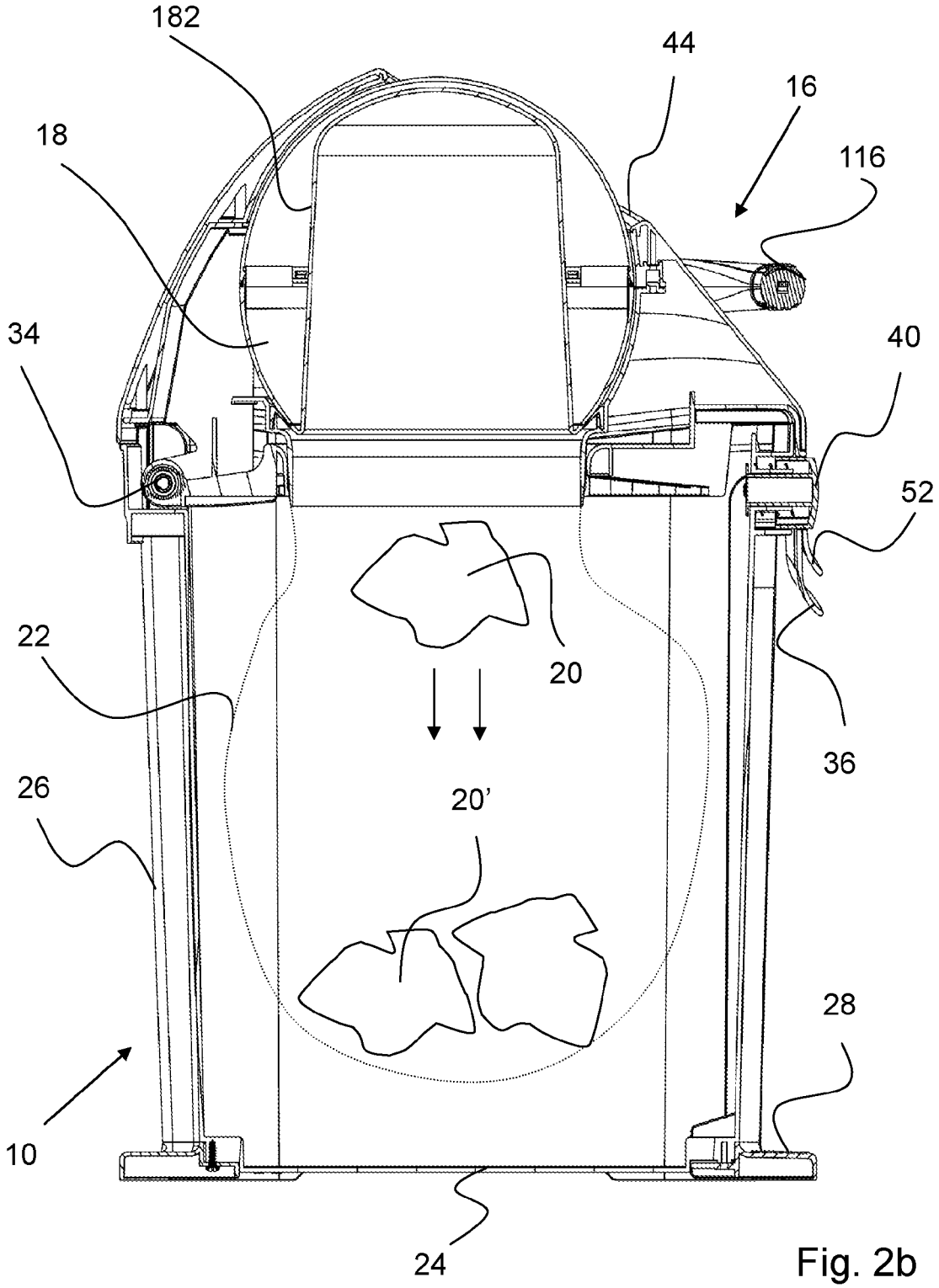
FIG. 2B—is a side view in cross section of the diaper pail of FIG. 1, in the transit position.

FIG. 2*a* shows the waste disposal device 10, having the container 12 with a bottom wall 24 and upwardly extending circumferential walls 26, and having a container opening at the end remote from the bottom 24. On top of the container the cover member 16 is provided. Bag holder means 32 are provided near the opening of the container 12 for holding a bag 22. In the bag, the diapers 22' to be disposed are contained. The bag holder means 32 define an opening in line with the container opening. A drum assembly 18 is provided on top of the container opening, and above the bag holder means 32.

The drum assembly 18 includes a drum housing 58 provided in the internal part of the waste device, said drum housing having a drum opening defined by edge 72 of the drum housing. The drum opening is aligned with the container opening, such that it faces the interior of the container 12.

The drum assembly 18 also includes a drum body 78, having an external surface 78 that is at least partially closely connected to an inner surface 58 of the drum housing 58. The drum body 18 is provided with a waste transport container defined by a circumferential wall 182 extending inwardly from the external surface 78 of the drum body, and ending in a bottom 181 of the waste transport container. The drum body 78 is pivotable by means of the actuator handle 116, between an insertion position (as shown in FIG. 2*a*) and a transit position (FIG. 2*b*). In the insertion position refuse is placeable in the transport container 181, 182. In the transit position the transport container 181, 182 is aligned with the drum opening, such that any waste present in the transport container may be transported to the bag present in the container.

According to the invention, a flexible sealing member 64 is provided, to prevent odor release from the inside of the bag to the surroundings. Said sealing member 64 extends about the circumferential edge 72 of the drum opening of the drum housing 58. The sealing member of the invention will further be described in relation to FIGS. 3 and 4.

First however, the general functioning of the diaper pail 10 will be described. In use, the user that wants to dispose of refuse, such as a diaper, will make sure to position the diaper in the position shown in FIG. 2*a* (insertion position). The user may do this by moving the actuator handle to the back side of the container 12. In this situation, the transport container 181, 182 is in line with the cover opening 44, and the user may dispose the diaper 20 inside the transport container 181, 182.

The user will then pivot the drum body 78 with respect to the drum housing 58 by pivoting the actuator handle 116 towards the front of the diaper pail 10. The drum body and the opening of the transport container are then pivotally moved towards the position shown in FIG. 2*b*. In the transit position shown in FIG. 2*b* the transport container 181, 182 is aligned with the drum opening, such that any waste present in the transport container may be transported to the bag present in the container.

During the movement of the drum body, and in both the transit position and the insertion position, the sealing member engages the outer surface of the drum body in a sealingly manner, and thus odor release to the surroundings is prevented.

Figure 3:
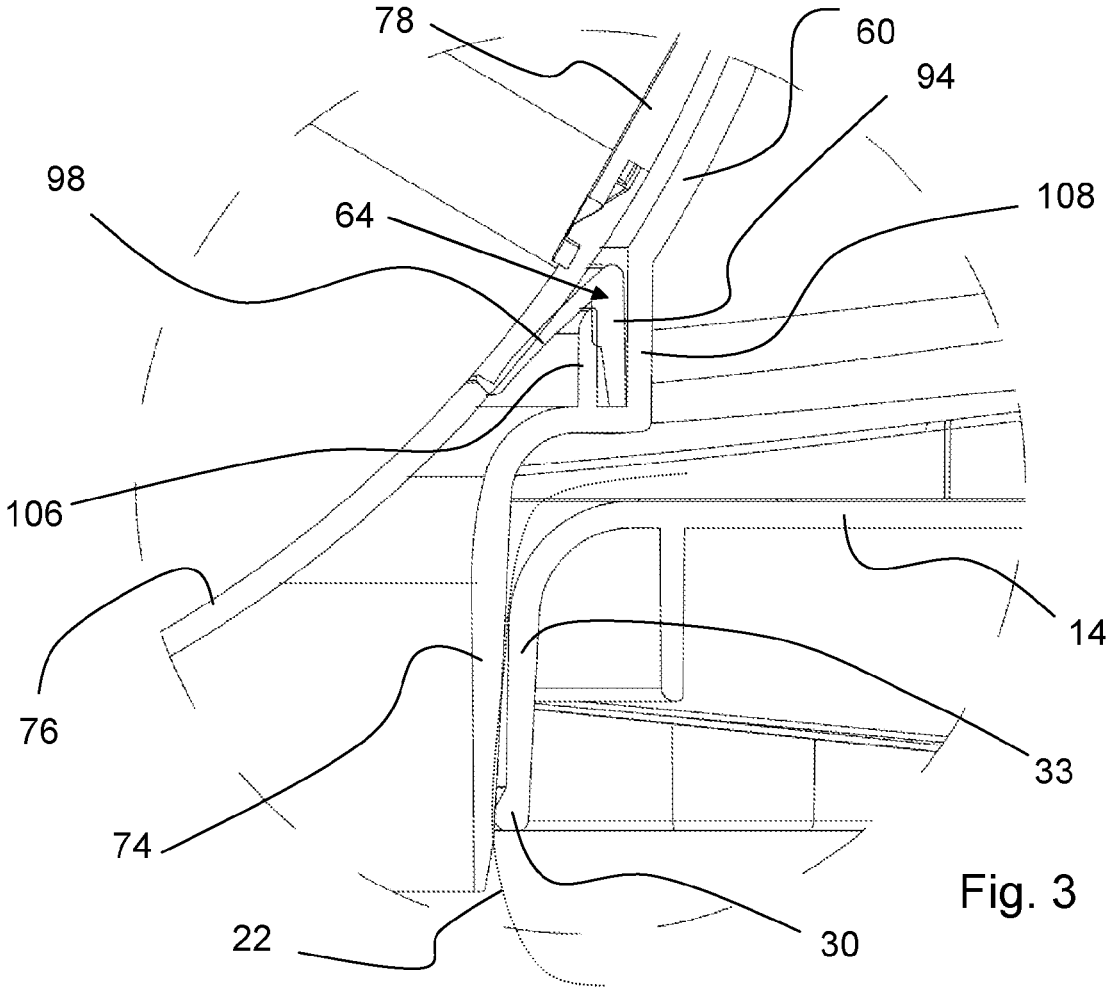
FIG. 3—is an enlarged side view in cross section of the sealing member of the diaper pail of FIG. 1, in the insertion position as shown in FIG. 2A.
Figure 4:
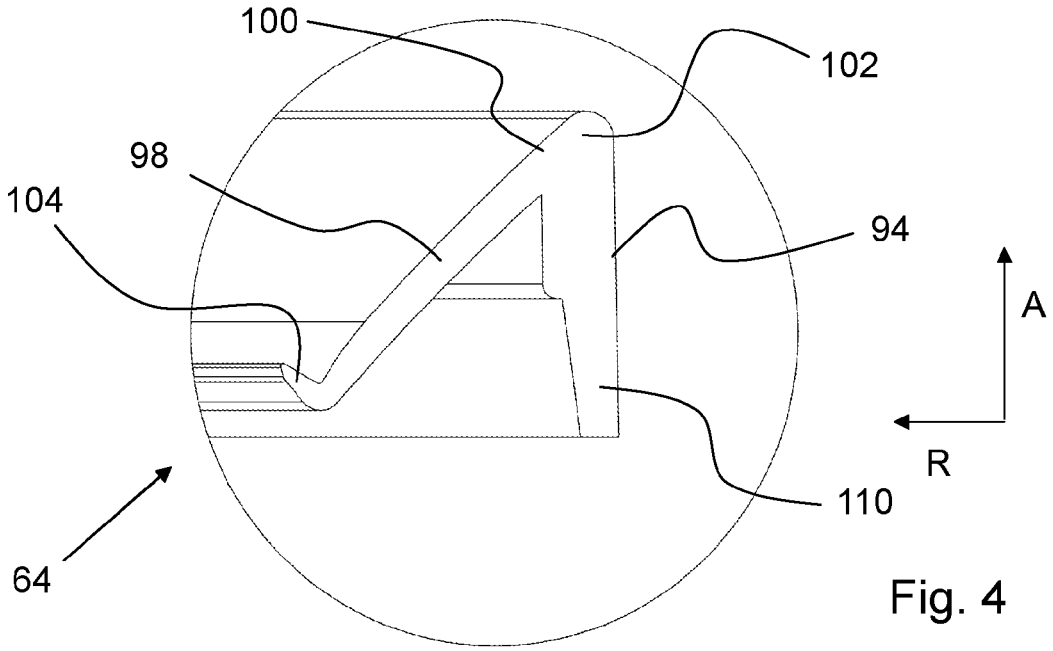
FIG. 4—is an enlarged view in axial cross section of the sealing member.

As can be seen in FIG. 4, which shows an axial cross section of the sealing member generally indicated in FIG. 3 with reference sign 64, the sealing member 64 comprises a connection part 94, 110 that is located radially outwards, as well as a sealing part 98, 104, 100 that extends radially inward from the connection part 94, 110. According to the invention, the end 104 of the sealing member that is remote from the connection 94 part is freely movable. The end 104 of the sealing part 98 that is remote from the connection part 94, 110 is free from any connection to the drum housing such that a freely movable outer end 104 of the sealing member 64 is formed. Due to the fact that the sealing part 98 is a flexible part that is connected 100 to an upper part 102 of the connection part 94, the part 104 that is remote from the connection part 94 is to a great extent freely movable in the positive and negative axial direction (arrow A), and independently thereof, movable in the positive and negative radial direction (arrow R). Preferably, the radially most inner part of the sealing member is a free end that forms the sealing edge by contacting the drum body.

The sealing member may be made of a Low Density Polyethylene (LDPE), since it has excellent flexible characteristics, and is virtually unbreakable. Furthermore, it is resistant to diluted and concentrated acids, alcohols, bases and esters, such that cleaning will provide no problem. Other materials, such as TPE, are conceivable.

Figure 9A:
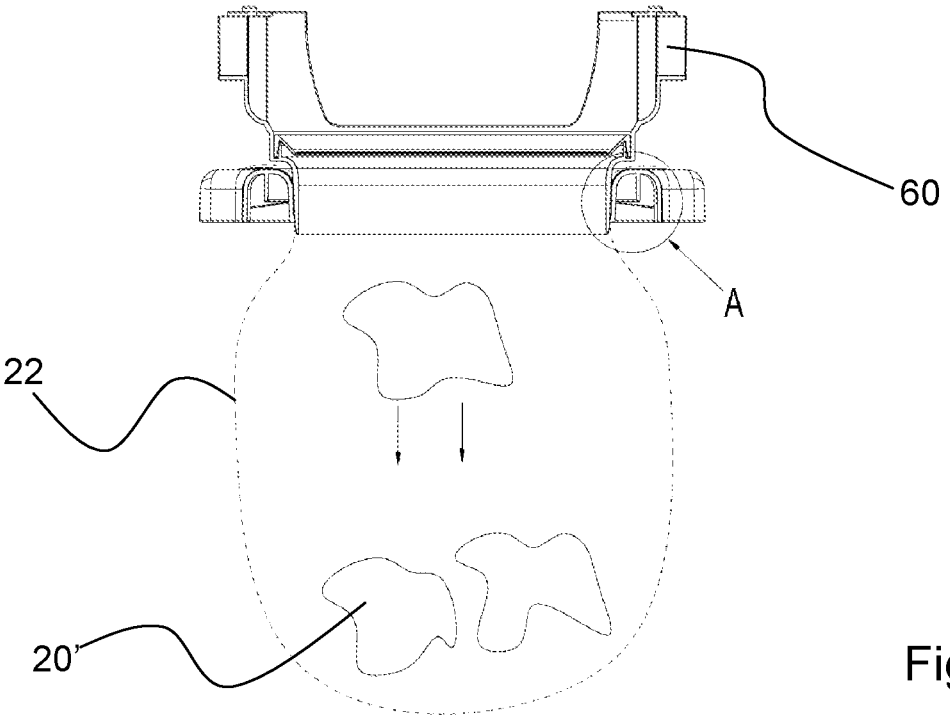
FIG. 9A—is a side view in cross section of the bag holder means.
Figure 9B:
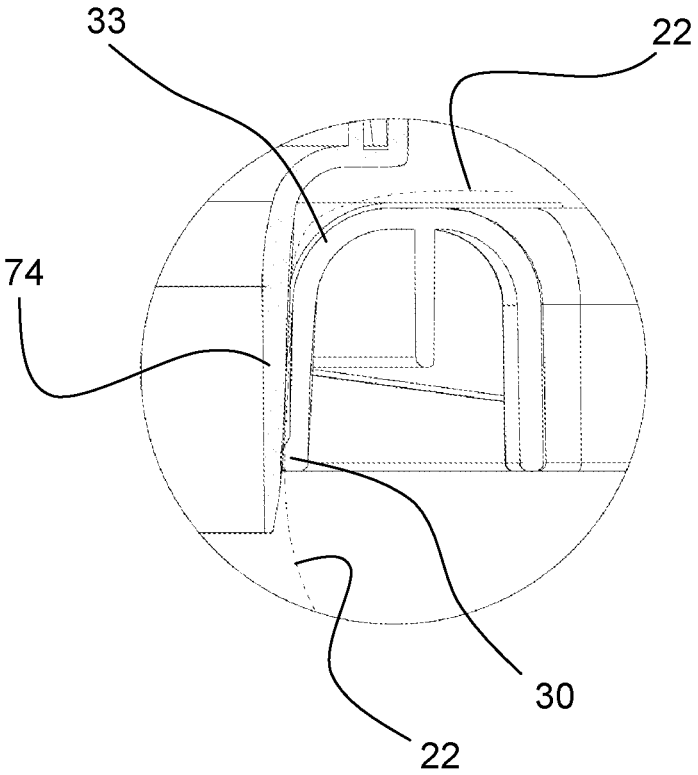
FIG. 9B—is an enlarged side view in cross section of the bag holder means as shown in FIG. 9A.

The form in combination with the material (LDPE) of the sealing member according to the invention ensures a self-returning property, which ensures a tight fit to the drum body. Other materials may be used to obtain these properties. In an assembled state, the flexible seal member takes the position as shown in FIG. 3. FIG. 3 shows a detail of the diaper pail shown in FIG. 2*a*, wherein the diaper pail is in the insertion position. FIG. 3 shows the bag holder means 14, having a flange 33 extending towards the bottom of the container, and which defines an edge of a bag holder opening. Inside the bag holder opening, a top part of a bag 22 is placed. The bag itself may be connected to the bag holder means 14, which will be described later on. Inside the top part of the bag 22, a downwardly projecting neck 74 of the drum housing extends towards the bottom of the container. The neck 74 shows a relatively tight fit with the bag holder opening, such that the top of bag 22 (when present) itself is tightly sealed in between the part 74 and the flange, to prevent odor release. A more detailed and simplified view of this can be seen in FIGS. 9*a* and 9*b*. FIG. 9*a* shows a side view of the drum housing 60, with a bag 22 attached to the bag holder means. A clear detail, referenced in FIG. 9*a* as "A", is shown in FIG. 9*b*. Here it can be seen that the bag 22 is tightly fitted between the flange and the drum housing 60. To this end, the end of the neck 74, or preferably the end of the flange 33 may be provided with a thickened portion 30, which engages the other of the neck 74 or the flange 33. The thickened portion 30 preferably is a relatively flexible portion.

Referring back to FIG. 3, it can be seen that on the upper end of the neck 74, the sealing member 64 is provided. The connection part 94 is positioned in between two flange-like portions 106, 108. It is noted that in the embodiment shown, the connection part is not fixedly connected to the flange-like portions. Rather, the connection part is freely movable, at least to some degree, in the flange-like portions 106, 108. The embodiment shown enables a movement in the axial direction, as indicated by arrow A in FIG. 4. The radial outer flange-like portion 108 continues upwardly in the drum housing 60. The drum body 76, 78 is pivotally provided on an inner surface of the drum housing 60. It can be seen in FIG. 3, that the sealing member 64, or at least the sealing part 98 thereof, engages the outer surface of the drum body 78. It is noted that in the situation shown, the flexible sealing member 64 adapts to the outer surfaces of the various parts of the drum body and drum housing very well, by elastically deforming (compression) whereas in FIG. 3, this deformation is not shown. The sealing member having a freely movable outer end, free from any connection to the drum housing 60 enables this. Thus, in fact, the radial inner end 104 of the sealing member 64, which extends upwardly in a direction away from the bottom of the container, is in contact with the outer surface of the drum body 78.

It can be seen in FIG. 3, that the radial inner end 104 of the sealing portion 98 of the sealing member 64 is not connected to the drum housing 74, 106, 108, but lies at a distance thereof, such that this free end 104 is freely movable with respect to the drum housing. This flexibility gives the sealing member an improved sealing function, since contact with the external surface of the drum body is ensured, and since it also allows easy movement of the drum body, whilst maintaining a good sealing contact. This is especially true when the connection part of the sealing member is not fixedly connected to the drum housing, but in a movable manner, as described above.

Preferably, the sealing member 64 comprises a substantially V-shaped cross section, with the legs of the "V" being formed by the connection part and the sealing part. The sealing member 64 may in an embodiment solely consist of a substantially V-shaped cross section, the V-shape solely being formed by an oblong sealing part and an oblong connection part. One leg of the V (the connection part) is then connected, in an embodiment in a slidable way, to the drum housing. The other leg of the V (the sealing part) is then freely movable, free from any connection to the drum housing. An angle (other then a straight angle) is formed between the two parts, wherein the angle is preferably in between 30 degrees and 60 degrees, although other values are conceivable.

Figure 5:
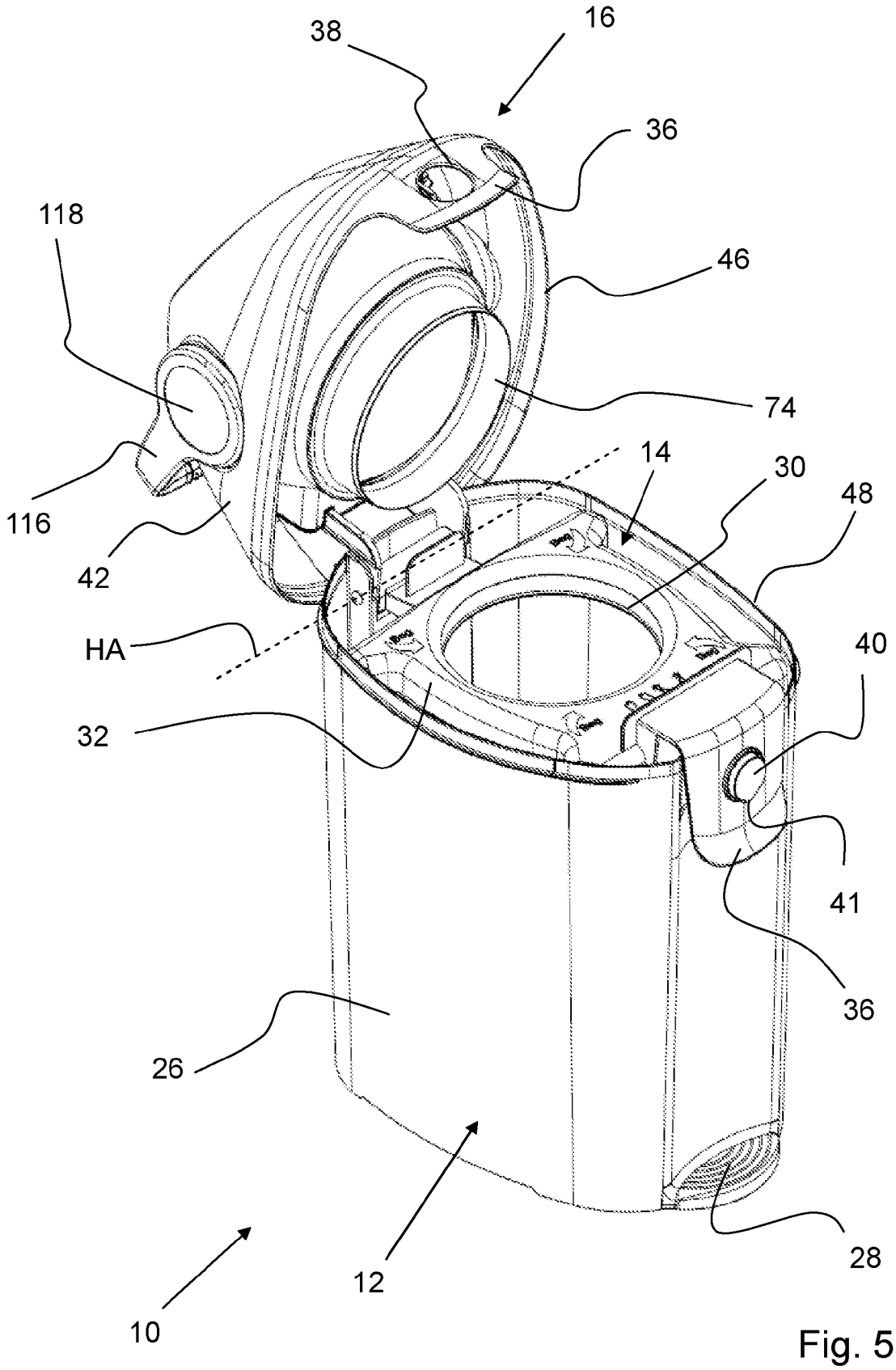
FIG. 5—is a perspective view of the waste disposal device of the present invention, in the embodiment of the diaper pail of FIG. 1, having an open cover.

To remove a full bag of diapers from within the pail 12, the cover member may be pivoted towards an open position shown in FIG. 5, by lifting tab 36. In the open position, the bag holder means 14 are exposed. The bagholder frame 14 has a generally square body portion with a central circular opening 30 through which the plastic disposal bag 22 is received. The rear edge of the body of the frame 14 includes a hinge body that is rotatably mounted to a mating hinge supported on the inner side of the rear wall 26 of the pail 12. The front edge of the frame 14 includes a flexible tab 36 (see also FIG. 1) which extends downwardly over the front wall of the pail 12. The tab 36 includes a small circular opening, which is received over a circular spring loaded button 40 housed within the front wall 26 of the pail 12 (see also FIG. 1). The button 40 is selectively depressed to allow the tab 36 to be released and the frame 14 to be pivoted upwardly to remove a full bag 22 from the pail 12. When returned to the closed position, the tab 36 slides over the button 40 until the button 40 seats itself within the circular opening 38.

FIG. 5 also shows details of the cover member 16, or upper enclosure 16. The upper enclosure 16 has an upper wall 42 having a circular opening 44 sized to allow a diaper 20 to pass through. The lower peripheral edge 46 of the upper wall 42 is shaped so as to interfit with the upper peripheral edge 48 of the sidewalls 26 of the pail and close off the interior of the pail 12. Similar to the bagholder frame 14, the rear edge of the upper wall 42 of the upper enclosure 16 includes a hinge body which is pivotally hinged to the rear wall of the pail 12. In fact, it is preferred that the upper enclosure 16 and the bagholder frame 14 share the same hinge axis HA. The front edge of the upper enclosure 16 also includes a flexible tab 52 including a circular opening 54, which is received over the spring loaded button 40 in the front wall of the pail 12. The spring loaded button 40 thus releasably holds both the frame 14 and the upper enclosure 16 in the closed positions.

It is pointed out that the upper wall 42 of the enclosure 16 is provided with a substantially smooth and continuous outer surface over substantially all of the enclosure structure. This design feature takes into consideration the practical realities of attempting to place soiled diaper into the pail 10 in actual use. The user is typically preoccupied with attending to the baby, and may not be able to provide sufficient attention to the act of carefully inserting the diaper into the opening 44. It is highly probably and likely that the soiled diaper will contact the outer surface of the enclosure 16 during use of the pail 10. It is therefore an important consideration to provide the ability to easily inspect and clean this area for proper maintenance and use of the pail 10. As indicated above, the substantially smooth and continuous outer surface provides a minimum number of holes and gaps in the outer surface which can allow odors to escape from the pail while also providing an easily inspected and cleaned outer surface in an area adjacent to where the diaper is inserted.

Figure 6:
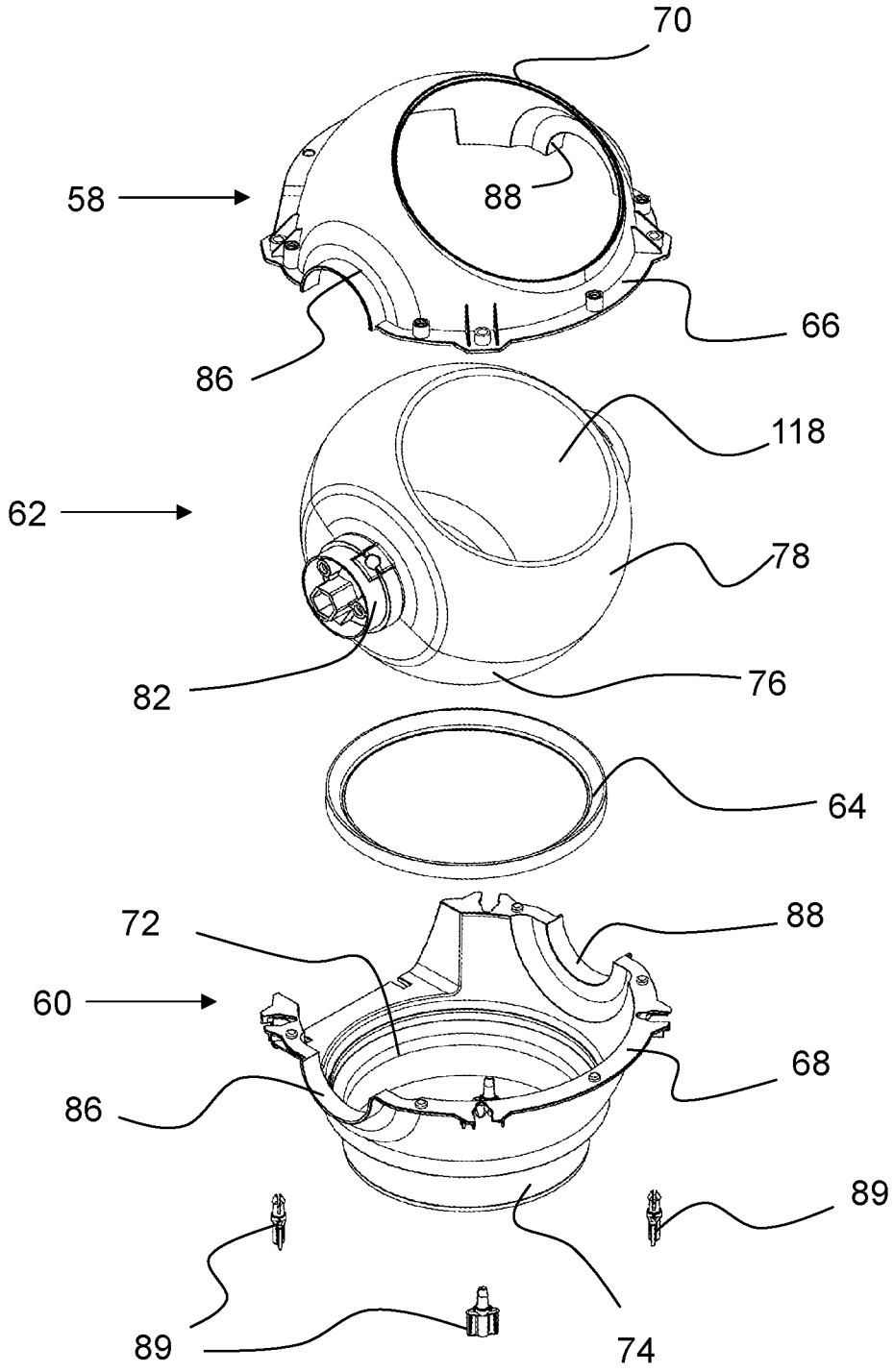
FIG. 6—is an exploded view in perspective of the drum housing and drum body of the diaper pail of FIG. 1.

Turning now to FIG. 6, the drum assembly 18 generally includes a two-piece drum housing having an upper drum housing portion 58 and a lower drum housing portion 60, a two-piece spherical drum body 62 and a flexible annular seal 64 constructed in accordance with the teachings of the present invention. The upper drum housing portion 58 and the lower drum housing portion 60 are provided with flanges 66, 68 for connecting the parts together. Turn screws 89 are provided to this end, although other means for connecting may be applied. Both upper and lower drum housing portions have recessed portions 86, 88, which are formed to receive outwardly projecting rotating members 82 of the drum body 60, which are to be connected to the rotating handle 116 (see FIG. 1).

Figure 7:
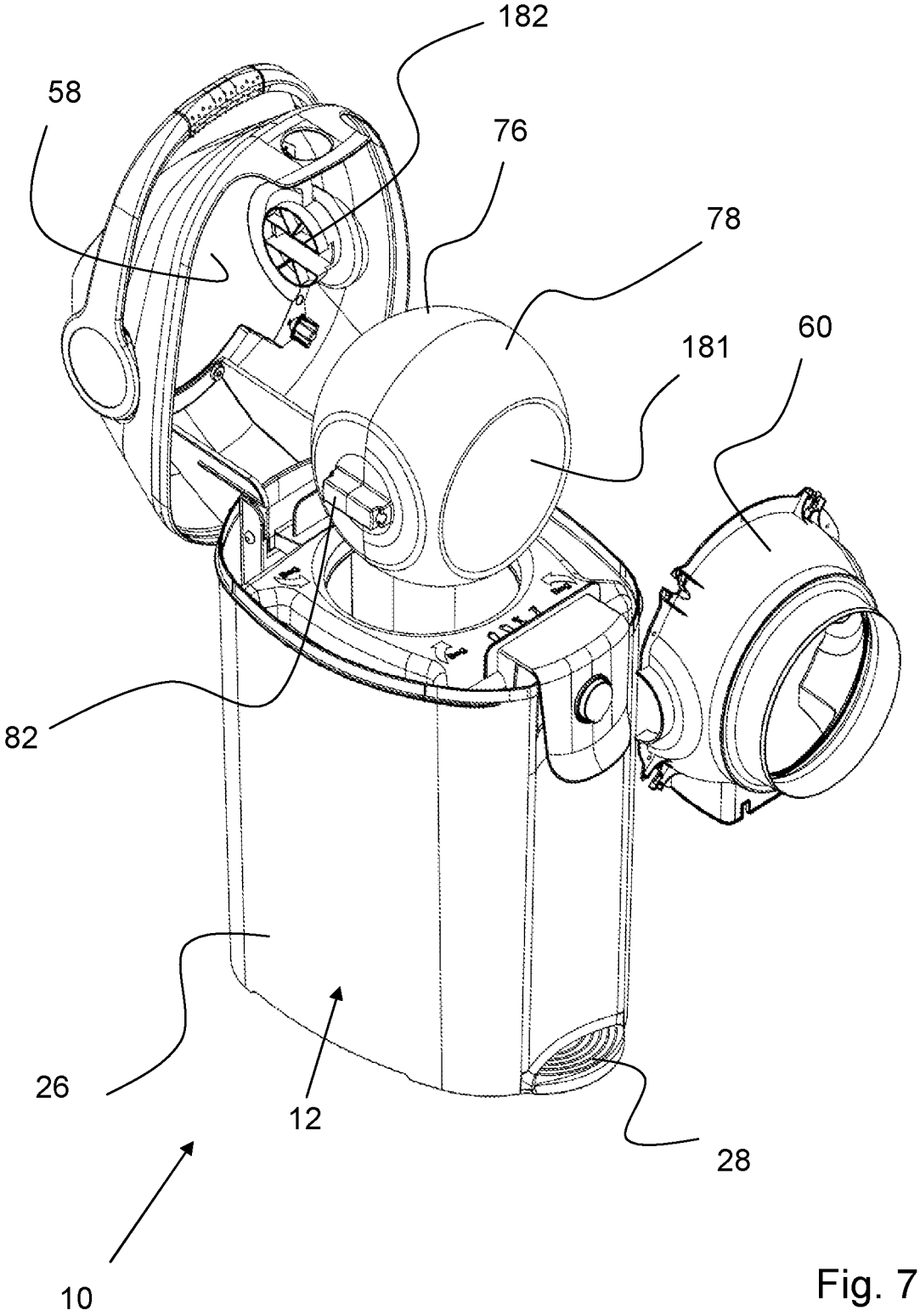
FIG. 7—is an exploded view in perspective of the waste disposal device, showing the assembly of the drum housing and the drum body.
Figure 8:
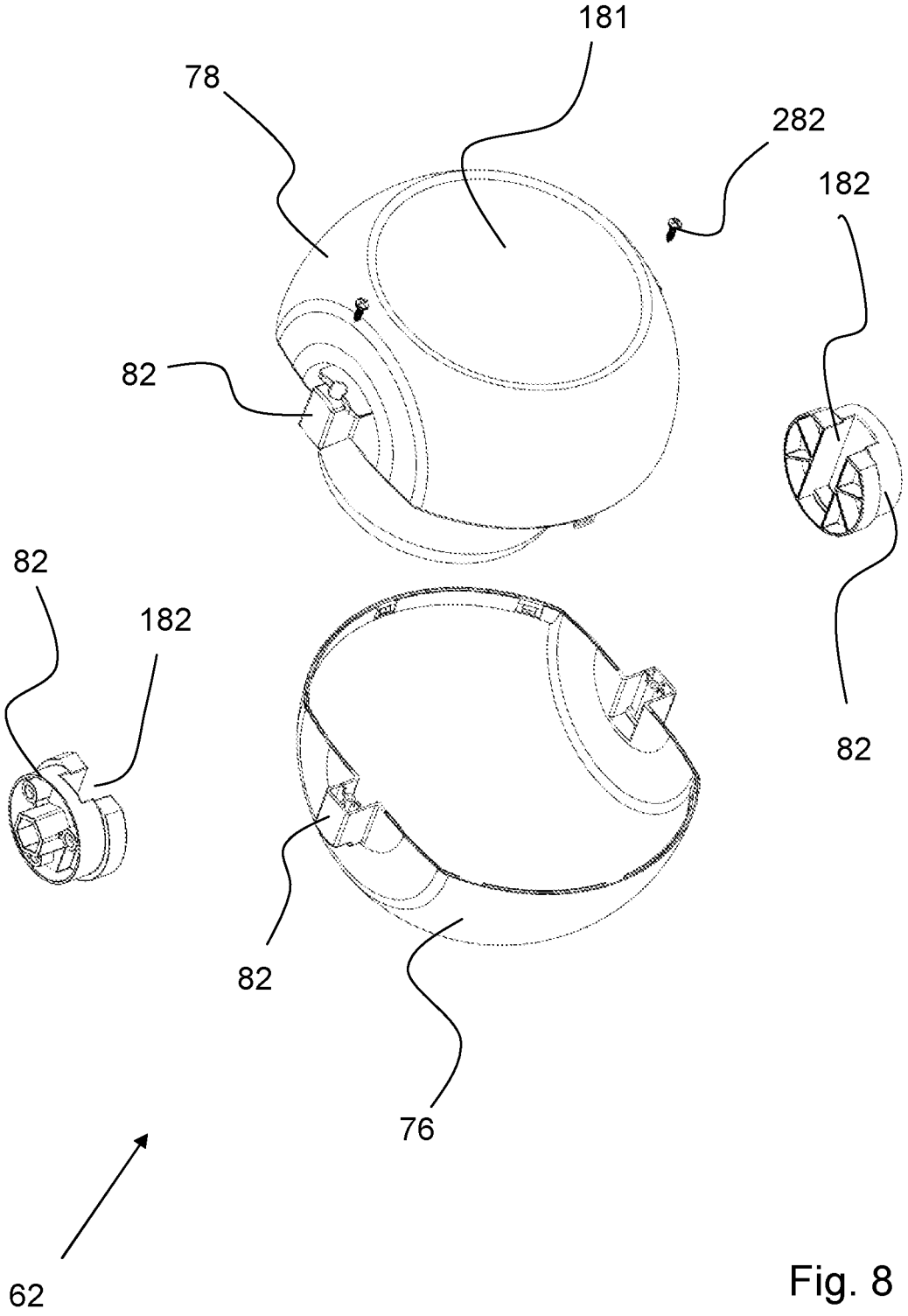
FIG. 8—is an exploded view in perspective of the drum body of the diaper pail of FIG. 1.

FIG. 7, shows the assembly of the drum assembly 18 into the diaper pail 10. The upper drum housing portion 58 is positioned inside the cover member 16. The drum body 76, 78 is slidably movable into the upper drum housing portion 58, in such a way that under the influence of gravity, the drum body will move towards the sealing member 64 in the transit position. A more detailed view can be seen in FIG. 8. FIG. 8 shows a greater detail of the drum body 62, showing that the drum body 62 consists of two hemispherical parts 76, 78. The upper part comprises the transport container 181. The lower part 76 may be attached to the upper part by means of screws 282 or the like. At the connection of the hemispheres 76, 78 sideward extending projections 82 are visible, which are to be received in grooves 182 of the rotating members 82 that are connected to the handle 116.

Referring back to FIG. 7, guide members 82 projecting from the surface of the drum body are moved in recessed guides 182 provided in the drum housing portion 58. The guide members 82 are arranged such that the drum can only be inserted in one way, i.e. upside-down placement is not possible. The recessed guides form part of the axle 118, as shown in FIG. 1. By rotating the actuator handle 116, the drum body is thus also rotated, and by this, the drum body is movable from the insertion position to the transit position. The lower drum housing portion 60 with the sealing member 64 may then be placed on top thereof, thus enclosing the drum body in between the two drum housing portions. The drum housing portions may be connected by means of turn-screws 89 as shown in FIG. 6, or by any other means necessary, although the turn-screws 89 provide an easy and fast way for attaching or removing the parts. It is noted that the drum body 76, 78 lies freely movable within the housing, in that sense that due to the guide members 82 a slight translational movement is possible in a direction along the guide members 82. This ensures a slight pressure on the sealing member 64, when the diaper pail is in the transit position.

While there is shown and described herein a certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

The invention claimed is:

1. A waste device for refuse comprising a container having a bottom and a circumferential wall, wherein the container has a container opening on an end remote from the bottom, wherein the waste device is provided with closing means positioned near the container opening for substantially closing the container opening in such a way that odor release is prevented, wherein the closing means comprise:

a drum housing provided in an internal part of the waste device, the drum housing having a drum opening facing an interior of the container;

a drum body having an external surface that is at least partially closely connected to an inner surface of the drum housing, wherein the drum body has a transport container for the refuse, the transport container extending inwardly from the external surface thereof, wherein the drum body is pivotable between an insertion position wherein refuse is placeable in the transport container, and a transit position wherein the transport container is aligned with the drum opening;

a flexible sealing member extending about a circumferential edge of the drum opening of the drum housing, wherein the sealing member, as seen in an axial cross-section, comprises a connection part that is located radially outwards, and that is connected to the drum housing, and wherein the sealing member comprises a sealing part connected to the connection part, the sealing part free from any connection to the drum housing and extending radially inward from the connection part and which may be brought into sealing contact with the external surface of the drum body for sealing the container opening in a substantially odor-free manner, and wherein a radial end of the sealing part remote from the connection part is free from any connection to the drum housing such that a freely movable free end of the sealing member is formed;

and wherein the radial end of the sealing part extends upwardly in a direction away from the bottom of the container and is in contact with the external surface of the drum body.

2. The waste device according to claim 1, wherein the connection part is movably connected, in an axial direction, to the drum housing.

3. The waste device according to claim 2, wherein the connection part is slidably received in a groove of the drum housing.

4. The waste device according to claim 1, wherein the sealing part extends radially inward from the connection part, towards the bottom of the container, wherein the sealing part subsequently continues to extend further radially inward, in a direction away from the bottom of the container.

5. The waste device according to claim 1, wherein the drum body is slidably connected to the drum housing, in such a way that in the transit position the drum body is pressed, under the influence of gravity, on the sealing member.

6. The waste device according to claim 1, wherein the drum body is substantially spherical in shape, wherein the inner surface of the drum housing is a substantially complementary shape, wherein the outer edge of the drum opening is substantially circular, and wherein the sealing member is substantially annular having a substantially annular sealing part engaging with the substantially spherical outer surface of said drum body.

7. The waste device according to claim 6, wherein the drum body is shaped such that in at least the insertion position the drum body is pressed on the sealing member and/or the inner surface of the drum housing has a shape that is not entirely complementary to the drum body and/or the drum body is connected to the drum housing in an off-centered way.

8. The waste device according to claim 1, wherein the waste device further comprises a cover configured and arranged to be received on the container, wherein the cover comprises a cover opening for supplying waste to the container, wherein the drum housing, when the cover is placed on the container, at least partially encloses the drum body, and wherein, in the insertion position, the transport container is aligned with the cover opening.

9. The waste device according to claim 1, wherein the waste device further comprises bag holder means for aligning a bag-like container with the drum opening.

10. The waste device according to claim 9, wherein the bag holder means comprises a holder housing having a holder opening, wherein the holder housing is connected to the container, and wherein the holder opening is aligned with the drum opening.

11. The waste device according to claim 10, wherein the drum opening comprises a wall that extends from the drum opening towards the bottom of the container, wherein the wall engages the edge of the holder that is formed by the opening of the holder.

* * * * *